US005381171A

United States Patent [19]

Hosono et al.

[11] Patent Number: 5,381,171

[45] Date of Patent: Jan. 10, 1995

[54] INK-JET RECORDING HEAD

[75] Inventors: Satoru Hosono; Nobumasa Abe, both of Nagano, Japan

[73] Assignee: Seiko Epson Corporation, Tokyo, Japan

[21] Appl. No.: 82,451

[22] Filed: Jun. 25, 1993

[30] Foreign Application Priority Data

Jun. 26, 1992 [JP] Japan ..... 4-169328
Dec. 8, 1992 [JP] Japan ..... 4-328157
Jun. 11, 1993 [JP] Japan ..... 5-166251

[51] Int. Cl.[6] ..... B41J 2/045

[52] U.S. Cl. ..... 347/72; 310/328; 310/366

[58] Field of Search ..... 346/140 R; B41J 2/045, B41J 2/055; 310/328, 330, 363–366, 334, 345, 348, 350; 347/72, 68, 94

[56] References Cited

U.S. PATENT DOCUMENTS 4,364,068 12/1982 Lewis ..... 346/140 R
5,153,477 10/1992 Tomura et al. ..... 310/328

FOREIGN PATENT DOCUMENTS 3-173652 7/1991 Japan .
3-274157 12/1991 Japan ..... B41J 2/045

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

The ink-jet recording head including a piezoelectric vibrator 9 in which layers of a piezoelectric material and an electrode forming material are alternately stacked to form an active region 15 where segment electrodes 20 and common electrodes 21 overlap with each other in the center portion; a fixing substrate 8 to which the piezoelectric vibrator 9 is fixed; and a flow path component which contacts with the front end of the piezoelectric vibrator 9 and in which ink is compressed by the extension and contraction of the piezoelectric vibrator 9 to produce ink drops. In the ink-jet recording head, the piezoelectric vibrator 9 is contacted with the fixing substrate 8 only in the portion of the active region 15, and fixed thereto by an adhesive. When a drive signal is applied to the electrodes 20 and 21 of the piezoelectric vibrator 9, only the active region 15 where electrodes of the opposite polarities oppose to each other extends in the lamination direction. Since the edge portions which do not contribute to this extension operation are free from the fixing substrate 8, they contract while following the extension of the active region 15 as closely as possible.

11 Claims, 7 Drawing Sheets

9
21a
11
20
20a
22
15
21
12
13
28
29
10
8

INK-JET RECORDING HEAD

BACKGROUND OF THE INVENTION

1. Industrial Field

The invention relates to an ink-jet recording head using as vibrating means a piezoelectric vibrator in which layers of a piezoelectric material and an electrode material are alternately stacked.

2. Related Art

Ink-jet recording heads in which a pressure is applied to ink in a pressure chamber to eject ink drops through nozzle openings are roughly classified into two types: the thermal jet type in which a heating element is housed in the pressure chamber; and the piezoelectric type in which the pressure chamber is pressed by a piezoelectric vibrator. The latter one has a feature that the deterioration of ink quality does not occur because ink is not heated, and therefore it can be used in a wide variety of applications such as a color printing.

However, an ink-jet recording head of the ink-jet recording head has a problem. Namely, in order to make the piezoelectric vibrator deform in a degree sufficient for producing ink drops, a drive voltage of several hundred volts must be applied to the piezoelectric vibrator, whereby signal transmission lines and circuit components are required to have a high insulation property.

In order to solve this problem, an improved ink-jet recording head is proposed, for example, in Unexamined European Patent Publication No. 0 443 628 A2. In the improved recording head, a piezoelectric vibrator for compressing and expanding a pressure chamber consists of layers of a piezoelectric material and an electrode material which are alternately stacked.

According to the proposed configuration, the driving voltage can be lowered to about 30 volts so that the structures of the driving circuit and power supply means can be simplified.

In the proposed configuration, layers of the two different materials, the piezoelectric material and the electrode material are stacked. This produces a drawback that the strength of the piezoelectric vibrator having such a lamination structure has a lower strength than that of a piezoelectric vibrator having a monolithic piezoelectric vibrator substrate.

SUMMARY OF THE INVENTION

The invention has been conducted in view of the above- mentioned problems, and has an object of providing a novel ink-jet recording head in which a lamination piezoelectric vibrator is riot caused to generate a useless stress and which can improve the energy efficiency.

In order to solve the problem, according to the invention, in an ink-jet recording head comprising: a piezoelectric vibrator in which layers of an electrode forming material and a piezoelectric material are alternately stacked, and an active region is formed in the center portion so as to extend and contract in the lamination direction, the electrode forming material constituting segment electrodes and common electrodes; a fixing substrate to which the piezoelectric vibrator is fixed; and a flow path component which contacts with the front end of the piezoelectric vibrator and in which ink is compressed by the extension and contraction of the piezoelectric vibrator to produce ink drops, the contacting area between the piezoelectric vibrator and the fixing substrate is formed only in the portion of the active region, and the piezoelectric vibrator is fixed to the fixing substrate only through the contacting area.

When a drive signal is applied to the segment electrodes and the common electrodes of the piezoelectric vibrator, only the active region where electrodes of the opposite polarities oppose to each other extends and contracts in the lamination direction. At this time, the side faces and lower edge portion of the piezoelectric vibrator which do not contribute to this extension and contraction operation are free from the fixing substrate, so that they contract while following the extension of the active region as closely as possible. As a result, the stress at the edge portion of the piezoelectric vibrator is reduced to an extremely low level as compared with the case where the edge portion is fixed. Furthermore, the degree of extension in the electrode arrangement direction is increased because the contraction side is not restricted. Accordingly, the ink-jet recording head can produce ink drops with a higher efficiency.

DESCRIPTION OF THE PREFERRED EMBODIMENTS

Hereinafter, the invention will be described in detail by illustrating its embodiments.

Figure 1:
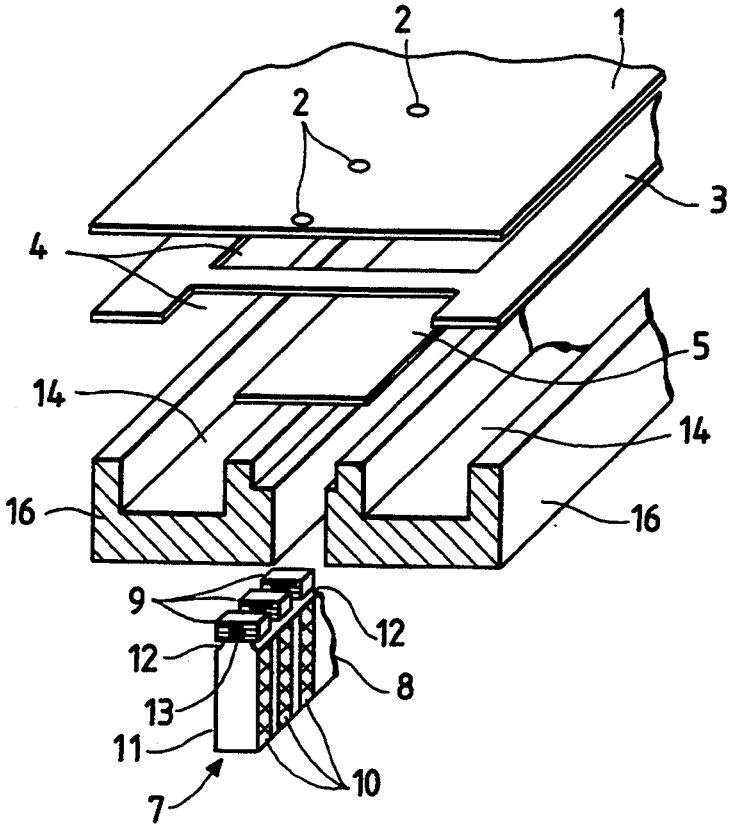
FIG. 1 is an exploded perspective view showing an embodiment of the invention.
Figure 2:
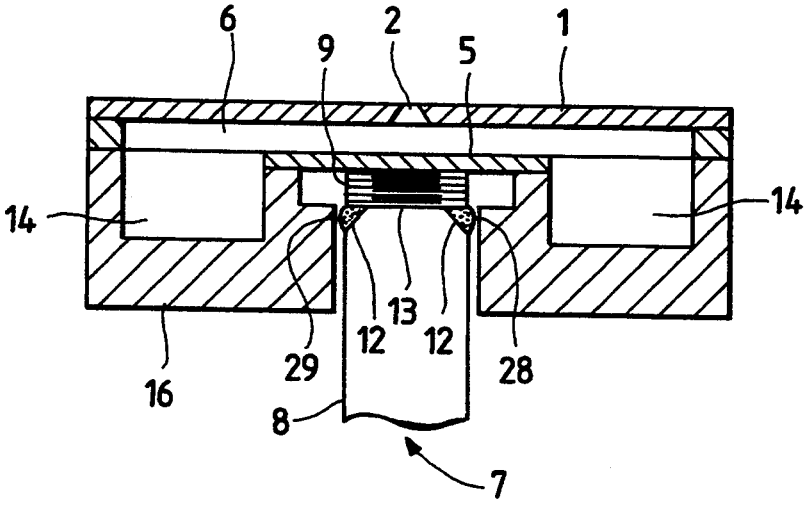
FIG. 2 is a section view showing the embodiment of the invention.

FIGS. 1 and 2 are an exploded perspective view and section view showing an embodiment of the invention, respectively. In the figures, the reference numeral 1 designates a nozzle plate in which nozzle openings 2 are formed, 3 designates a spacer which partitions a pressure chamber 6 and has through holes 4, and 5 designates a diaphragm which contacts with piezoelectric vibrators 9 of a piezoelectric vibrating unit 7 described later and deforms in accordance with extension and contraction of the piezoelectric vibrator 9. These three kinds of components are stacked to constitute a flow path unit forming the pressure chamber 6.

Figures 3A, 3B, 3C:
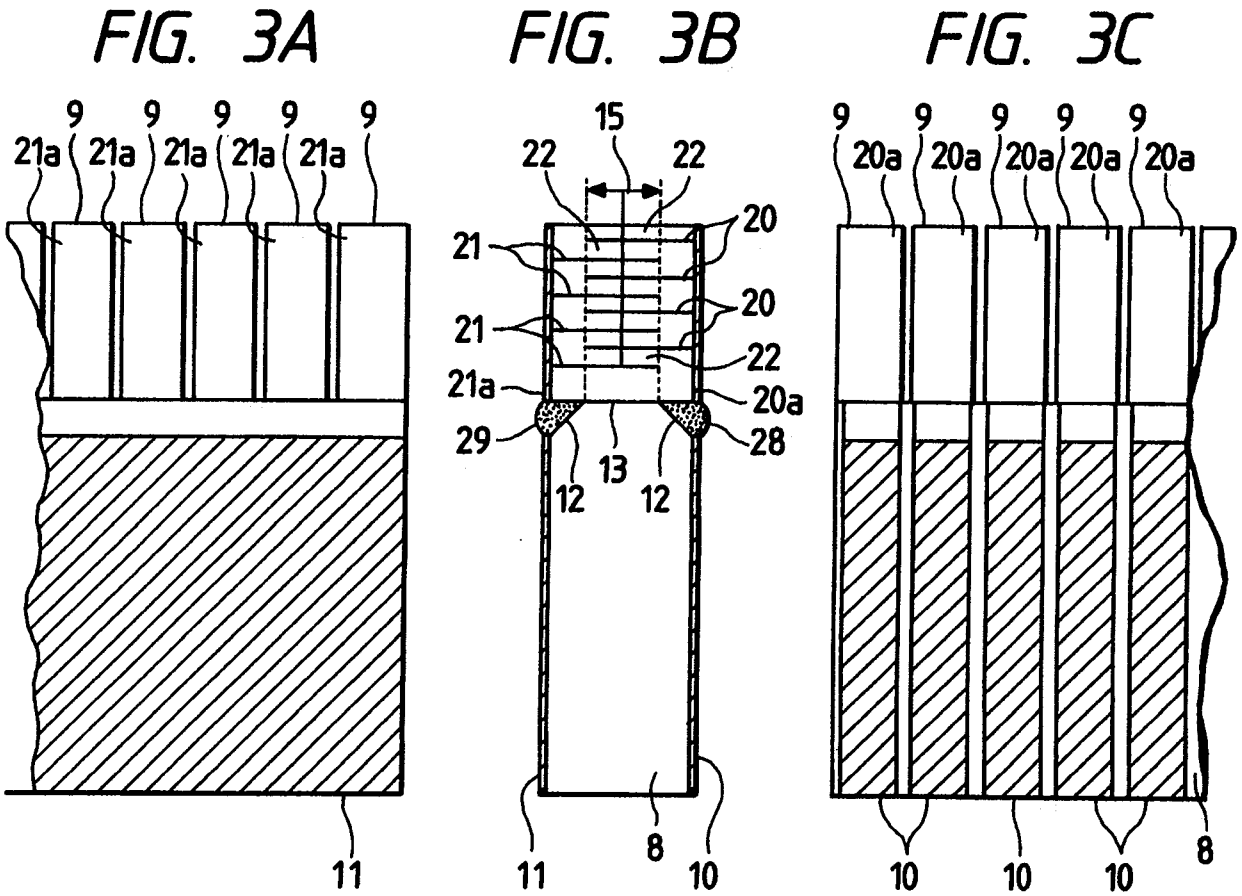
FIGS. 3A, 3B and 3C show the configuration of side faces of an embodiment of the piezoelectric vibrating unit of the recording head.

The reference numeral 7 designates the piezoelectric vibrating unit which is a characteristic component of the invention. The lamination piezoelectric vibrators 9 are fixedly attached to the front end of a fixing substrate 8. On the side faces of the fixing substrate 8, formed are lead electrodes 10 and 11 which respectively connect the piezoelectric vibrators 9 with external terminals. Portions of the fixing substrate 8 which oppose the sides of the piezoelectric vibrators 9 are removed away to form chamfered portions 12. Only a flat portion 13 which constitutes the remaining portion contacts with active regions 15 (FIG. 3) of the piezoelectric vibrators 9 to fix the piezoelectric vibrators 9.

The thus configured flow path unit and piezoelectric vibrator unit are fixed to each other through bases 16 each having a groove constituting an ink supply path 14, to be assembled into a recording head.

FIG. 3 shows the vibrating unit 7 in detail. In the figure, the reference numeral 9 designates the piezoelectric vibrators having a lamination structure in which layers of an electrode material such as silver palladium for forming segment electrodes 20 and common electrodes 21, and layers of a piezoelectric material such as lead titanate for forming piezoelectric vibration layers 22 are alternately stacked in the thicknesses of 3 μm to 5 μm and 20 μm to 50 μm, respectively. More specifically, one-side ends of the electrodes of the one polarity, or the electrodes 20 to which a drive signal is applied, and those of the common electrodes 21 are elongated to the opposite side faces of the piezoelectric vibration layers 22, and the other ends of these electrodes are positioned in the vicinity of the center portion of the piezoelectric vibration layers 22, so that the electrodes 20 and 21 of the opposite polarities are overlapped only in the center portion.

When the unit having this configuration is sintered, the segment electrodes 20 overlap the common electrodes 21 by a predetermined length in the center portion to constitute a region where the electrostriction phenomenon is produced, or the so-called active region 15. Then, on the side face on which the ends of the segment electrodes 20 are exposed, and the other side face on which the ends of the common electrodes 21 are exposed, side electrodes 20*a* and 21*a* are formed by vapor deposition or the like, so that the electrodes 20 and 21 are connected in parallel by the side electrodes 20*a* and 21*a*, respectively. When a voltage as low as about 30 volts is applied to the thus configured piezoelectric vibrator, the electrostriction phenomenon is caused to produce the displacement of the piezoelectric vibrator, thereby pressing the diaphragm 5 constituting the pressure chamber 6 to produce ink drops.

In the fixing substrate 8, both the side edges of the upper face are removed away to form chamfered portions 12, so that the flat portion 13 is formed only in the portion opposing to the portion of the piezoelectric vibrator 9 where the electrodes are overlapped, or the active region 15. On the whole side face (FIG. 3A) in the side on which the ends of the common electrodes 21 are exposed, the lead electrode 11 is formed by vapor deposition or the like. On the side face (FIG. 3C) in the side on which the ends of the segment electrodes 20 are exposed, the plurality of lead electrodes 10 are formed by vapor deposition or the like at locations corresponding to the piezoelectric vibrators 9, respectively.

The thus configured fixing substrate 8 and piezoelectric vibrators 9 are assembled into the vibrating unit 7 in the following manner. A nonconductive adhesive is applied to the top of the fixing substrate 8, or the flat portion 13 in a thickness as thin as possible. Under the state where the piezoelectric vibrators 9 are substantially contacted to the fixing substrate, 8, the vibrators 9 are fixed to the substrate in the pitch coincident with that of the nozzle openings 2. Into the spaces having a V-shaped section and formed by the chamfered portions 12 of the fixing substrate 8 and the end faces of the piezoelectric vibrators 9, conductive adhesives 28 and 29 which have elasticity even after setting are poured. More specifically, the conductive adhesives 28 are poured into the space in the side of the side electrodes 20a in such a manner that separation strips are formed between the conductive adhesives 28, and the conductive adhesive 29 is poured into the whole space in the side of the side electrodes 21*a*.

As a result, the segment electrodes 20 of the piezoelectric vibrators 9 are electrically connected through the side electrodes 20*a* to the independent lead electrodes 10, respectively, and the common electrodes 21 of the piezoelectric vibrators 9 are electrically connected to the lead electrode 11 common to the side electrodes 21*a*. Then, conductive patterns such as flexible cables are connected to the lead electrodes 10 and 11 so that the piezoelectric vibrators 9 are selectively supplied with a drive signal.

Figure 4A:
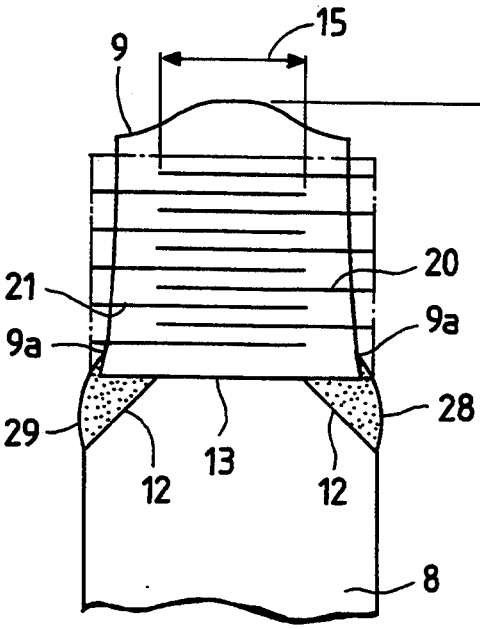
FIGS. 4A and 4B respectively show extension states of the recording head according to the invention and a prior art recording head to which a drive signal is applied.

In the embodiment, when a drive signal is applied to one of the piezoelectric vibrators 9, the active region 15 where the electrodes 20 and 21 of the opposite polarities overlap with each other extends in the electrode arrangement direction as shown in FIG. 4A. The inactive regions where only the electrodes of one polarity exist and the electric field is not produced do not contribute to this extension. In the piezoelectric vibrator 9, only the active region 15 where the electrodes 20 and 21 of the opposite polarities overlap with each other is supported by the fixing substrate 8, and the inactive regions of the both sides are fixed by the conductive adhesives 28 and 29 having elasticity, so that edge portions 9*a* are kept free in the view point of the piezoelectric phenomenon. Therefore, the piezoelectric vibrator as a whole extends without suffering restriction from the fixing substrate 8, and presses the diaphragm 5.

Figure 4B:
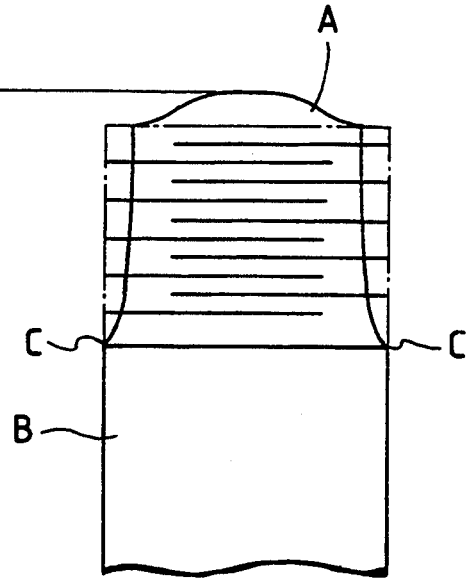
FIG. 4B PRIOR ART

As a result, as compared with a conventional recording head (FIG. 4B) in which the whole lower face of a piezoelectric vibrator A is fixed to a fixing substrate B and edge portions C are restricted, the degree of extension (unit volume change) of the embodiment is increased by $\Delta L$, and the energy efficiency of producing ink drops is improved. Furthermore, since the edge portions 9*a* are free from restriction, the generated stress is low in level and the fatigue is reduced.

In the embodiment, the vibrators 9 which are independently constructed are fixed to the fixing substrate 8 in the pitch coincident with that of the nozzle openings 2. Alternatively, the vibrators 9 may be formed in the following manner. A piezoelectric vibrator plate 33 is constructed into the form of a monolithic plate by alternately stacking layers of a piezoelectric material 30 and electrode forming materials 31 and 32. Only the active region of the piezoelectric vibrator plate 33 is fixed by an adhesive to a fixing substrate 34 having chamfered portions 37. Then, slits 35 which elongate from the upper face of the piezoelectric vibrator plate 33 and reach the surface of the fixing substrate 34 are formed by a diamond saw 36 or a wire saw. According to this alternative, the process of fixing the piezoelectric vibrators can be simplified.

Figure 6:
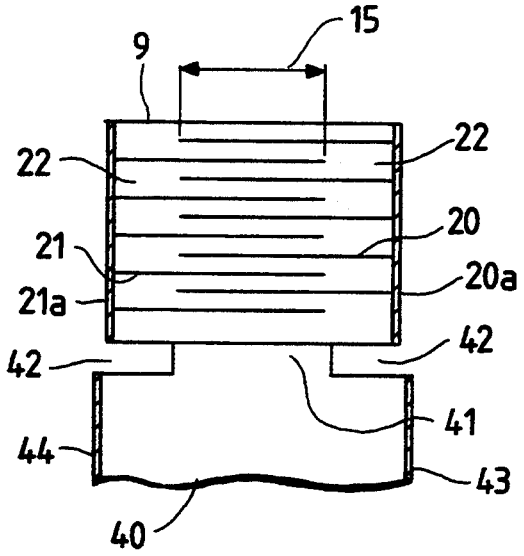
FIG. 6 shows another embodiment of the invention.
Figure 7:
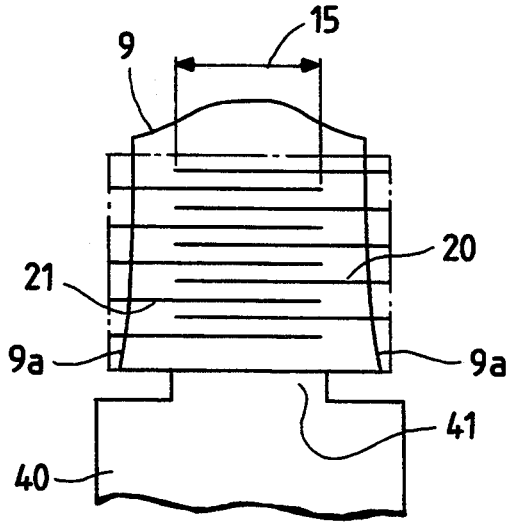
FIG. 7 shows a state of the embodiment when a drive voltage is applied.

FIG. 6 shows a second embodiment of the invention. In the figure, the reference numeral 40 designates a fixing substrate to which the piezoelectric vibrator 9 is fixed. A projection 41 is formed at a portion opposing the active region 15 of the piezoelectric vibrator 9 so that the fixing substrate contacts with only the active region 15 of the piezoelectric vibrator 9 to fix it, resulting in that spaces 42 are formed between the inactive regions of the piezoelectric vibrator 9 and the fixing substrate 40. In the same manner as the above-described embodiment, the edge portions 9*a* of the piezoelectric vibrator 9 are kept free during the extension and contraction of the piezoelectric vibrator 9. When a drive signal is applied, therefore, the piezoelectric vibrator 9 produces a large displacement due to the extension as shown in FIG. 7 so that ink drops are produced with a higher efficiency, and is prevented from suffering from a useless stress. Accordingly, the fatigue of the piezoelectric vibrator 9 and fixing substrate 40 can be reduced.

Also in the embodiment, lead electrodes 43 and 44 are formed on the side faces of the fixing substrate 40, and conductive adhesives which have elasticity even after setting are poured into the spaces 42, thereby respectively connecting the side electrodes 20*a* and 21*a* of the piezoelectric vibrator 9 with the lead electrodes 43 and 44 of the fixing substrate 40.

Figure 5:
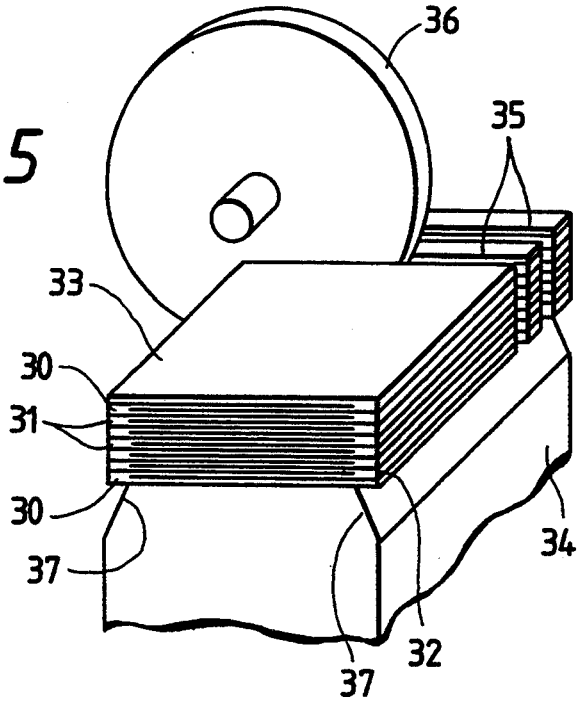
FIG. 5 shows an embodiment of the method of manufacturing the piezoelectric vibrator.

It is needless to say theft also the embodiment may be constructed in the same manner as described above in conjunction with FIG. 5. That is, one monolithic piezoelectric vibrator plate may be fixed to the fixing substrate 40 and then cut to be divided into respective vibrators of a predetermined size.

Figure 8:
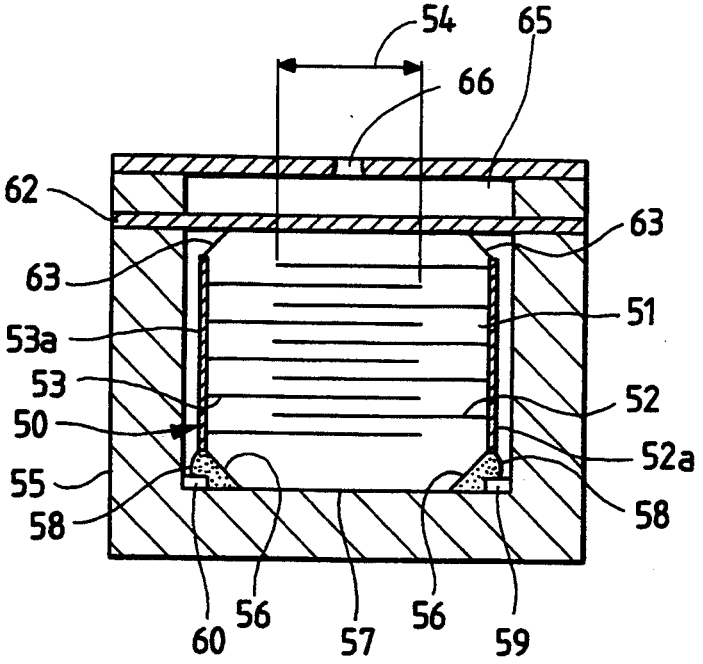
FIG. 8 is a section view showing a third embodiment of the invention.

FIG. 8 shows a third embodiment of the invention. In the figure, the reference numeral 50 designates a piezoelectric vibrator. In the piezoelectric vibrator 50, layers of an electrode forming material are alternately stacked in such a manner that they oppose to each other through a piezoelectric material, to form segment electrodes 52 and common electrodes 53, thereby constituting active region 54 of piezoelectric vibration layers 51 in the center portion. The edge portions of inactive regions which oppose a fixing substrate 55 are removed away to form chamfered portions 56.

The piezoelectric vibrator 50 is fixed at its flat portion 57 to the fixing substrate 55 by an adhesive. Into V-shaped grooves formed by the chamfered portions 56 and the fixing substrate 55, conductive adhesives 58 which have elasticity even after setting are poured so that side electrodes 52*a* and 53*a* of the piezoelectric vibrator 50 are connected to lead terminals 59 and 60, respectively.

In the embodiment, chamfered portions 63 are also formed in the edge portions in the other end side of the piezoelectric vibrator 50 which contacts with a diaphragm 62, so as to provide for an escape of an adhesive for connecting the piezoelectric vibrator 50 with the diaphragm 62. This allows an excess of an applied adhesive to flow into the chamfered portions 63, thereby preventing the excess adhesive from entering into the gaps between the adjacent piezoelectric vibrators. The adhesive in the chamfered portions 63 functions as the reinforcement of the connection between the diaphragm 62 and the piezoelectric vibrator 50.

When a drive signal is applied to the piezoelectric vibrator 50 in the embodiment, only the active region 54 extends so that the piezoelectric vibrator presses the diaphragm 62 to compress a pressure chamber 65, whereby ink drops are produced from a nozzle opening 66.

Figure 9:
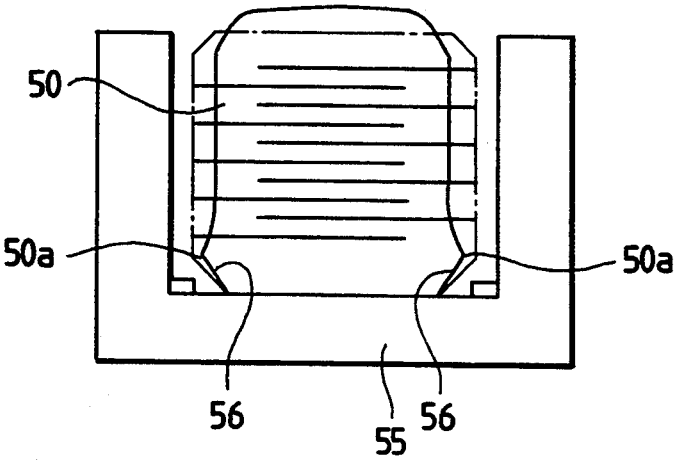
FIG. 9 shows a state of the embodiment when a drive signal is applied.

In accordance with the extension due to the application of the drive signal, as shown in FIG. 9, the piezoelectric vibrator 50 contracts in the direction perpendicular to the extension direction. Since edge portions 50*a* at the lower end are removed away, the piezoelectric vibrator 50 does not suffer restriction from the fixing substrate 55. Therefore, its front end can largely deform so that ink drops are produced with a higher efficiency and the fatigue of the piezoelectric vibrator 50 and fixing substrate 55 is reduced.

Figure 10:
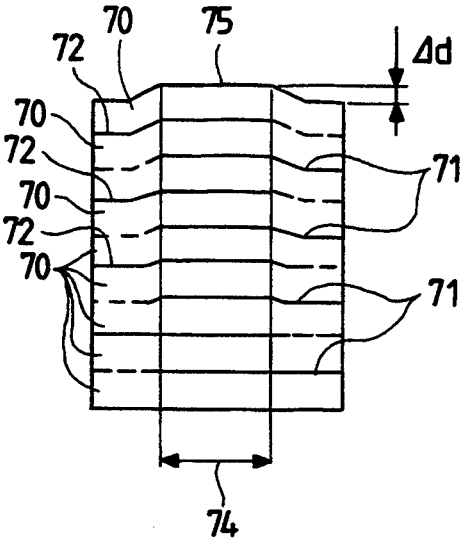
FIG. 10 is a section view showing an embodiment of a lamination piezoelectric vibrator.

In the embodiment, the chamfered portions are formed by performing a special working process such as that of abrading the edge of the piezoelectric vibrator. Alternatively, such chamfered portions may be formed without performing such a special working process. In the process of forming a lamination of a piezoelectric material, green sheets 70 having a given thickness, and green sheets 71 and 72 of an electrode forming material are stacked as shown in FIG. 10. As a result, the region in which the electrodes vertically overlap with each other or the region which constitutes an active region 74 has the total layer number that is greater than that of other portion by the number of the electrode forming material green sheets functioning as the electrodes of one polarity. Eventually, therefore, the active region has a projection 75 having a step difference $\Delta d$.

Figure 11:
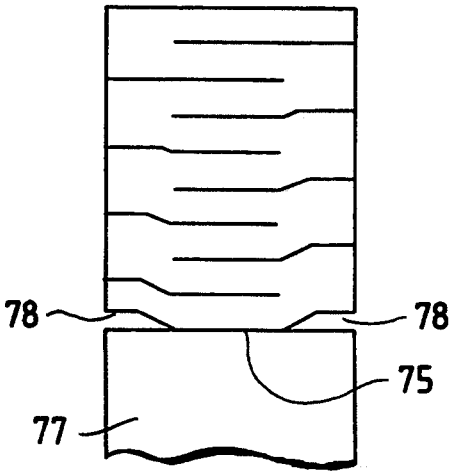
FIG. 11 shows a fourth embodiment of the invention in which the piezoelectric vibrator is used.

After the piezoelectric vibrator having this configuration is sintered, as shown in FIG. 11, the projection 75 is contacted with a fixing substrate 77 and fixed thereto by an adhesive, whereby spaces 78 are formed by the fixing substrate 77 and the both side portions constituting the inactive region. As a result, without performing a special working process of forming the chamfered portions, a piezoelectric vibrator unit can be constructed in which only the active region 74 is contacted with and fixed to the fixing substrate 77 and the edge portions are kept free.

Figure 12:
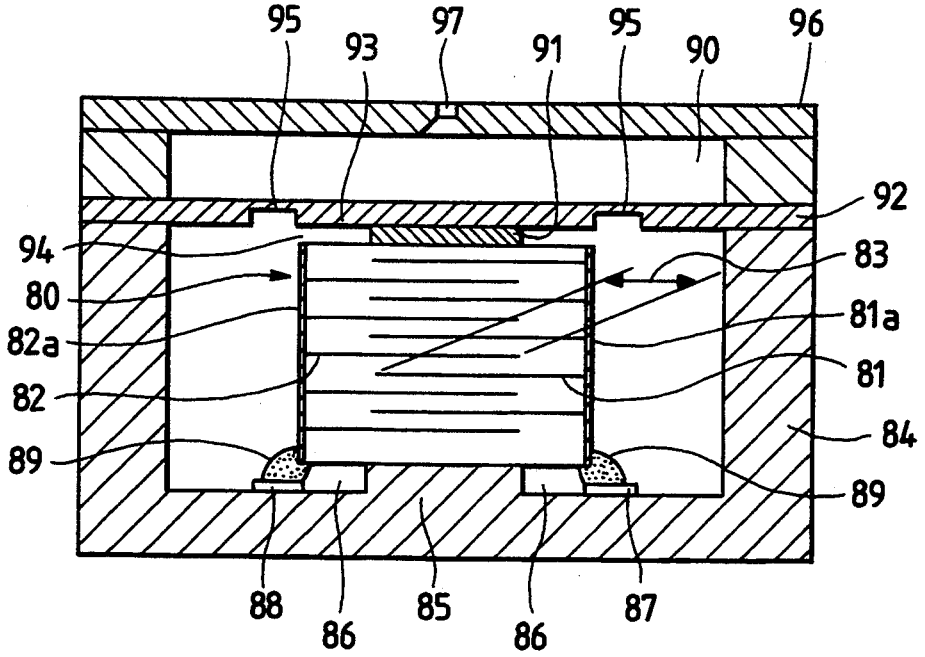
FIG. 12 is a section view showing a fifth embodiment of the invention.

FIG. 12 shows a fifth embodiment of the invention. In the figure, the reference numeral 80 designates a lamination piezoelectric vibrator in which segment electrodes 81 and common electrodes 82 are arranged in the manner described above so as to overlap with each other in the center portion, whereby an active region 83 is formed only in the center portion. The piezoelectric vibrator 80 is fixed by an adhesive to a projection 85 which is formed on a base 84 so as to oppose and contact only with the active region 83. This fixation is performed so that spaces 86 are formed between the inactive regions and the base 84. Side electrodes 81*a* and 82*a* which respectively connect the segment electrodes 81 and common electrodes 82 in parallel are fixed at lower ends thereof to lead electrodes 87, 88 disposed on the base 84 by a conductive adhesive 89 which maintains to perform elasticity even after fixed.

The other side of the piezoelectric vibrator opposing a pressure chamber 90 is contacted with and fixed to an island 93 of a diaphragm 92 through a connecting member 91 the size of which is selected so that the member contacts with only the active region 83, thereby ensuring spaces 94 to be formed between the inactive regions and the diaphragm 92. In the figure, the reference numeral 95 designates thin portions formed in the diaphragm 92, and 96 designates a nozzle plate having a nozzle opening 97.

When a drive signal is applied to the piezoelectric vibrator 80 in the embodiment, only the active region 83 extends in the manner described above so that the piezoelectric vibrator 80 presses the diaphragm 92 to compress the pressure chamber 90, whereby ink drops are produced from the nozzle opening 97.

Figure 13:
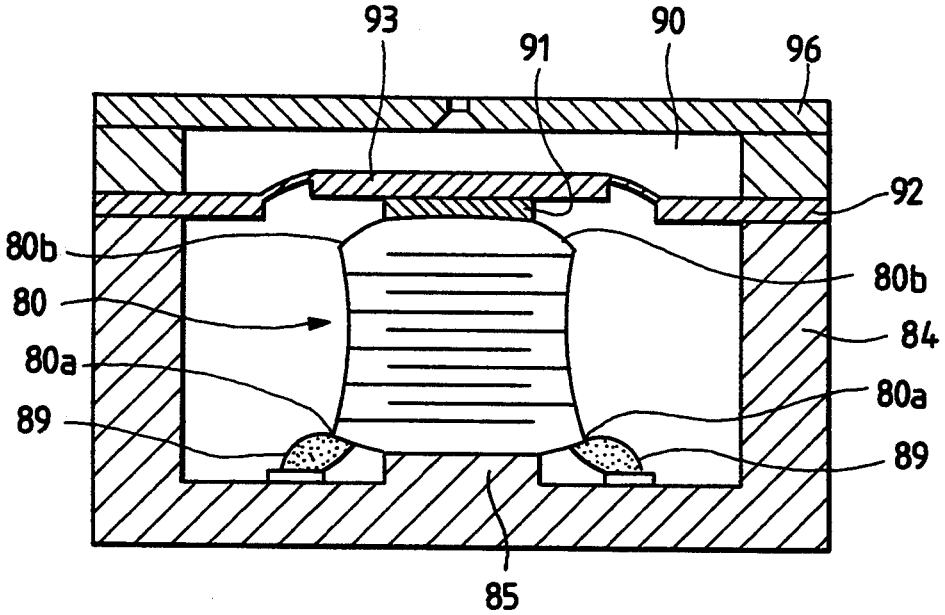
FIG. 13 shows the operation of the embodiment.

In accordance with the extension due to the application of the drive signal, as shown in FIG. 13, the piezoelectric vibrator 80 contracts in the direction perpendicular to the extension direction. With respect to the deformation of the piezoelectric vibrator 80, nonfixed inactive regions 80*a* at the lower end are fixed only by conductive adhesives 89 having elasticity, and, with respect to the diaphragm 92, nonfixed inactive regions 80*b* at the upper end are kept free. Accordingly, the contraction of the piezoelectric vibrator 80 does not suffer restriction from the base 84 and the diaphragm 92, so that the piezoelectric vibrator 80 contracts with a larger degree than that in which the whole front edge is fixed to a diaphragm. In the embodiment, therefore, ink drops are produced with a higher efficiency and the fatigue of the piezoelectric vibrator 80, base 84 and diaphragm 92 is reduced.

In the embodiment, the connecting member for connecting the active region of the piezoelectric vibrator with the diaphragm is constructed as a separate member. Alternatively, the connecting member may be constructed so as to be united in one body with the island of the diaphragm. In another alternative, a portion of the inactive region in the side of the diaphragm may be removed away as shown in FIG. 8, and only the active region is contacted with and fixed to the diaphragm or the island of the diaphragm. It is obvious to those skilled in the art that these alternatives achieve the same effects as those of the above-described embodiments.

As described above, according to the invention, in an ink-jet recording head comprising: a piezoelectric vibrator in which layers of an electrode forming material and a piezoelectric material are alternately stacked, and an active region is formed in the center portion so s to extend and contract in the lamination direction, the electrode forming material constituting segment electrodes and common electrodes; a fixing substrate to which the piezoelectric vibrator is fixed; and a flow path component which contacts with the front end of the piezoelectric vibrator and in which ink is compressed by the extension and contraction of the piezoelectric vibrator to produce ink drops, the contacting area between the piezoelectric vibrator and the fixing substrate is formed only in the portion of the active region, and the piezoelectric vibrator is fixed to the fixing substrate only through the contacting area. Therefore, the stress at the edge of the piezoelectric vibrator is reduced to an extremely low level. Furthermore, the degree of extension in the electrode arrangement direction is increased because the contraction side is not restricted. Accordingly, the ink-jet recording head can produce ink drops with a higher efficiency.

What is claimed is:

1. An ink-jet recording head comprising:

a piezoelectric vibrator having laminated layers of an electrode forming material and a piezoelectric material alternately stacked, an active region being formed in a center portion of said piezoelectric vibrator so as to extend and contract in a lamination direction, said electrode forming material constituting segment electrodes and common electrodes;

a fixing substrate to which said piezoelectric vibrator is fixed at one end hereof; and a flow path component which contacts with another end of said piezoelectric vibrator and in which ink is compressed by the extension and contraction of said piezoelectric vibrator to produce ink drops, wherein a contacting area is formed between said piezoelectric vibrator and said fixing substrate only in a portion of said active region, and said piezoelectric vibrator is fixed to said fixing substrate only through said contacting area.

2. The ink-jet recording head according to claim 1, wherein a chamfered portion is formed in a side of said fixing substrate contacting with said piezoelectric vibrator, by foiling a slope in said side except a portion opposing the active region of said piezoelectric vibrator.

3. The ink-jet recording head according to claim 1, wherein said fixing substrate has a projection which is formed in a portion opposing said active region of said piezoelectric vibrator, and the contact between said fixing substrate and the active region of said piezoelectric vibrator is done through said projection.

4. The ink-jet recording head according to claim 1, wherein a chamfered portion is formed in a side of said piezoelectric vibrator contacting with said fixing substrate, except the portion of said active region, and only said active region contacts with and fixed to said fixing substrate.

5. The ink-jet recording head according to claim 1, wherein said piezoelectric vibrator has a projection which is formed in said active region by a thickness of said electrode forming material constituting said segment electrodes and common electrodes, and said piezoelectric vibrator is fixed to said fixing substrate so that said projection contacts with said fixing substrate.

6. The ink-jet recording head according to any one of claims 1 to 5, wherein an adhesive which has elasticity even after setting is poured into a space of a non-contacting area formed between said piezoelectric vibrator and said fixing substrate.

7. The ink-jet recording head according to claim 6, wherein said adhesive is electrically conductive, and said piezoelectric vibrator is electrically connected with lead electrodes formed on said fixing substrate by said adhesive.

8. An ink-jet recording head comprising:

a piezoelectric vibrator having laminated of an electrode forming material and a piezoelectric material alternately stacked, an active region being formed in a center portion of said piezoelectric so as to extend and contract in the lamination direction, said electrode forming materials respectively constituting segment electrodes and common electrodes;

a fixing substrate to which said piezoelectric vibrator is fixed at one end thereof; and a flow path member which contacts with another end of said piezoelectric vibrator and in which ink is compressed through a diaphragm by the extension and contraction of said piezoelectric vibrator to produce ink drops, wherein contacting areas are formed between said piezoelectric vibrator and said fixing substrate, and between said piezoelectric vibrator and said diaphragm only in of said active region, and said piezoelectric vibrator is fixed to said fixing substrate and said diaphragm only through respective contacting areas.

9. The ink-jet recording head according to claim 8, wherein said diaphragm and said piezoelectric vibrator are fixed to each other through a connecting member having a size corresponding to a size of said active region.

10. The ink-jet recording head according to claim 9, wherein said connecting member is united with said diaphragm in one body.

11. The ink-jet recording head according to claim 8, wherein a part of an inactive region of said piezoelectric vibrator which part opposes said diaphragm is chamfered, and said contacting area between said piezoelectric vibrator and said diaphragm is substantially restricted to said active region.

* * * * *